US010934127B2

(12) United States Patent
Guo et al.

(10) Patent No.: US 10,934,127 B2
(45) Date of Patent: Mar. 2, 2021

(54) SPINDLE MECHANISM OF WINDING MACHINE

(71) Applicant: Xiamen Hongfa Industrial Robot Co., LTD, Xiamen (CN)

(72) Inventors: Fanlin Guo, Xiamen (CN); Jianming Liao, Xiamen (CN); Jiechang Bai, Xiamen (CN); Yinhua Liu, Xiamen (CN)

(73) Assignee: XIAMEN HONGFA INDUSTRIAL ROBOT CO., LTD, Xiamen (CN)

( * ) Notice: Subject to any disclaimer, the term of this patent is extended or adjusted under 35 U.S.C. 154(b) by 267 days.

(21) Appl. No.: 16/129,634

(22) Filed: Sep. 12, 2018

(65) Prior Publication Data

US 2019/0077628 A1 Mar. 14, 2019

(30) Foreign Application Priority Data

Sep. 14, 2017 (CN) ..... 201710825264.4

(51) Int. Cl.
*B65H 75/18* (2006.01)
*B65H 54/10* (2006.01)
*B65H 54/44* (2006.01)

(52) U.S. Cl.
CPC ..... *B65H 75/18* (2013.01); *B65H 54/106* (2013.01); *B65H 54/44* (2013.01); *B65H 2301/4132* (2013.01); *B65H 2402/24* (2013.01); *B65H 2402/521* (2013.01); *B65H 2402/5221* (2013.01); *B65H 2513/11* (2013.01); *B65H 2601/26* (2013.01)

(58) Field of Classification Search
CPC ..... H01F 41/06; B65H 75/18; B65H 54/106; B65H 54/44; B65H 2301/4132; B65H 2513/11; B65H 2402/24; B65H 2601/26; B65H 2402/5221; B65H 2402/521; B65H 54/40

See application file for complete search history.

(56) References Cited

U.S. PATENT DOCUMENTS 2,075,457 A * 3/1937 Nye ..... B65H 54/40 242/486.7
2,116,409 A * 5/1938 Parks ..... B65H 54/44 242/486.6
3,113,742 A * 12/1963 Bevan ..... H04L 13/06 242/545.1

(Continued)

FOREIGN PATENT DOCUMENTS

CN 204038764 U 12/2014

*Primary Examiner* — William A. Rivera
(74) *Attorney, Agent, or Firm* — Dorsey & Whitney LLP

(57) ABSTRACT

A spindle mechanism of a winding machine includes a spindle box provided with a mounting hole; bearings respectively arranged at both ends of the mounting hole of the spindle box to form a front bearing and a rear bearing, the bearing comprises an inner ring and an outer ring; and a spindle, the spindle is arranged to pass through the mounting hole of the spindle box and is rotatably positioned on the spindle box by means of the bearings, and the number of the front bearings is the same as the number of the rear bearings, and the outer ring of at least one of the front bearing and the rear bearing is not restricted in an axial direction so as to form a free end.

10 Claims, 8 Drawing Sheets

(56) References Cited

U.S. PATENT DOCUMENTS

| | | | | | |
|---|---|---|---|---|---|
| 3,547,362 | A * | 12/1970 | Kallenborn | B65H 54/44 | 242/484.6 |
| 3,653,602 | A * | 4/1972 | Harrington | A61F 15/007 | 242/419.4 |
| 3,788,826 | A * | 1/1974 | Klink et al. | B65H 59/388 | 65/486 |
| 4,114,819 | A * | 9/1978 | Kanki | B65H 54/44 | 242/486.6 |
| 5,762,276 | A * | 6/1998 | Migaki | B65H 54/40 | 242/486 |
| 9,707,136 | B2 * | 7/2017 | Broten | A61F 15/007 | |
| 2005/0159285 | A1 * | 7/2005 | Prum | B65H 45/168 | 493/356 |

* cited by examiner

SPINDLE MECHANISM OF WINDING MACHINE

CROSS REFERENCE

This application is based upon and claims priority to Chinese Patent Application No. 201710825264.4, filed on Sep. 14, 2017, the entire contents thereof are incorporated herein by reference.

TECHNICAL FIELD

The present disclosure relates to the field of winding machine, in particular a spindle mechanism of a winding machine.

BACKGROUND

At present, the rotation speed of the spindle of the winding machine in the market becomes increasingly higher due to mass production of winding machine, the result of which is damage caused by a high rotation speed of bearing for a long time. The Chinese utility model patent application No. 201420518252.9 discloses a spindle of winding machine. Currently, the spindle of winding machine has a structure in which there are three bearings. The two front bearings are angular contact bearing or deep groove ball bearing, and the rear bearing is one deep groove ball bearing. All spindles are synchronously rotated by the synchronous belt wheel at the rear end of the spindle. The highest rotation speed of the winding machine can be only 15000 rpm, which is difficult to be further increased. The existing spindle is damaged after usage of 24 hours per day for about 3 years. When the spindle is replaced, the angular contact bearing must be replaced by a professional, and it is very highly required for the professional of the factory to carry out the equipment maintenance. Damage to personnel and loss of production are unacceptable for the factory when the spindle is replaced.

SUMMARY

In one aspect, the present invention provides a spindle mechanism of a winding machine, comprising: a spindle box, a spindle, and bearings, wherein a mounting hole is provided on the spindle box, and the spindle passes through the mounting hole of the spindle box and is rotatably positioned on the spindle box by means of the bearings. The bearings are respectively arranged at both ends of the mounting hole of the spindle box to form front bearing and rear bearing. The number of the front bearings is the same as that of the rear bearings, and the outer ring of at least one of front bearing and rear bearing is not restricted in an axial direction so as to form a free end.

In some examples, the spindle mechanism of the winding machine further comprises a sleeve that is sleeved on the spindle between the front bearings and the rear bearings, wherein both ends of the sleeve respectively abut against the inner rings of front bearing and rear bearing.

In some examples, the sleeve is spaced away from an inner wall of the mounting hole of the spindle box.

In some examples, the spindle is respectively provided with a first abutting portion and a second abutting portion outside the front bearings and the rear bearings. The first abutting portion and the second abutting portion respectively abut against the inner rings of front bearing and rear bearing, and together with the sleeve, collectively clamp and fix the front bearings and the rear bearings.

In some examples, the spindle mechanism further comprises a synchronous wheel that is sleeved on the spindle, and the second abutting portion that abuts the inner ring of rear bearing is an extended structure of the synchronous wheel.

In some examples, the spindle box is further provided with limit structures, which restrict the bearings from being disengaged from the mounting hole.

In some examples, the diameter of the middle portion of the mounting hole is smaller than the diameter at both ends thereof to form limit structure of limit steps, and when the spindle box is offset from the bearings, the outer ring of the bearing at one end abuts against the limit step, to restrict the spindle box from being further offset, so as to restrict the bearings at the other end from being disengaged from the mounting hole of the spindle box.

In some examples, the spindle mechanism of the winding machine further comprises a bearing cap, wherein the front bearings and the rear bearings abut against the limit steps, and the bearing cap covers the end of the mounting hole and presses against the outer ring of front bearing or rear bearing, such that the outer ring of front bearing or rear bearing is entirely fixed on the spindle box, and the outer ring of rear bearing or front bearing is a free end in the axial direction.

In some examples, the front bearings and the rear bearings are deep groove ball bearing.

The technical solution of the present provides various advantages. For example, the number of the front bearings is the same as that of the rear bearings, and the outer ring at at least one end is not fixed in the axial direction so as to form a free end, which makes the force acted on the spindle at both ends more uniform, so as to provide basis for high speed operation. At the same time, the outer ring of bearing is in a free state in the axial direction, which can effectively eliminate thermal expansion or contraction of components caused by heat generated due to high speed operation of the bearing and increase the rotation speed of the spindle and reduce the incidence of damage. Furthermore, the outer ring of bearing is in a free state in the axial direction, which can eliminate the machining error and make the assembly, disassembly and replacement simpler.

DETAILED DESCRIPTION

Figure 1:
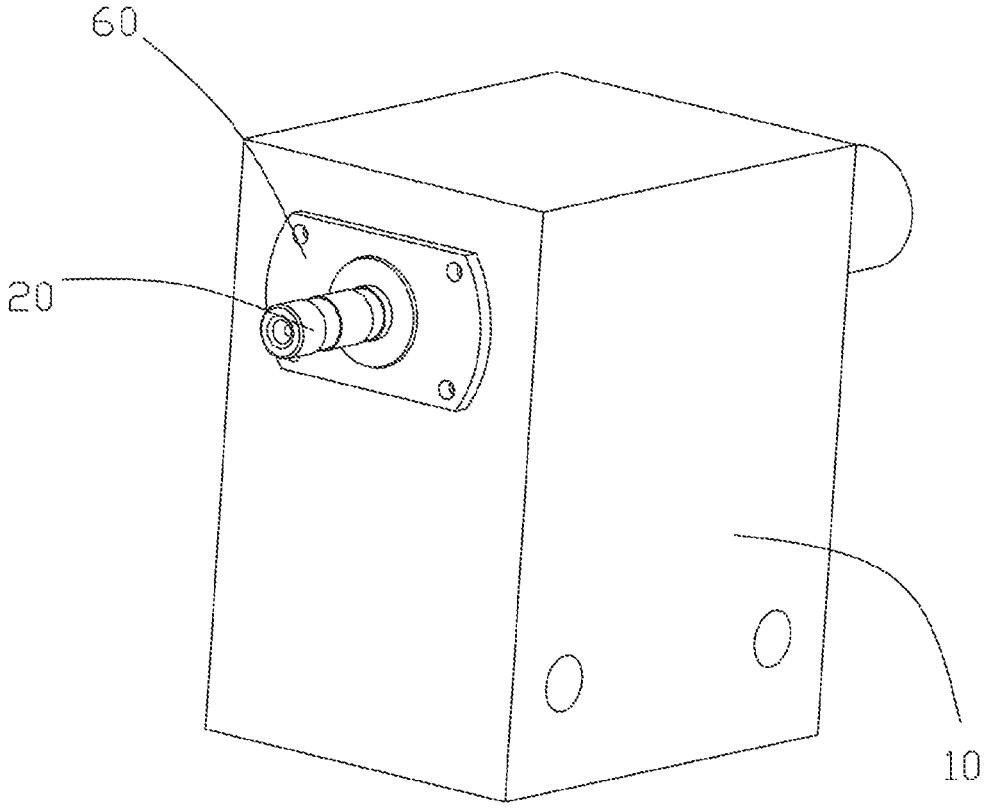
FIG. 1 is a perspective view schematically showing structure of a spindle mechanism of a winding machine according to some examples described herein.
Figure 2:
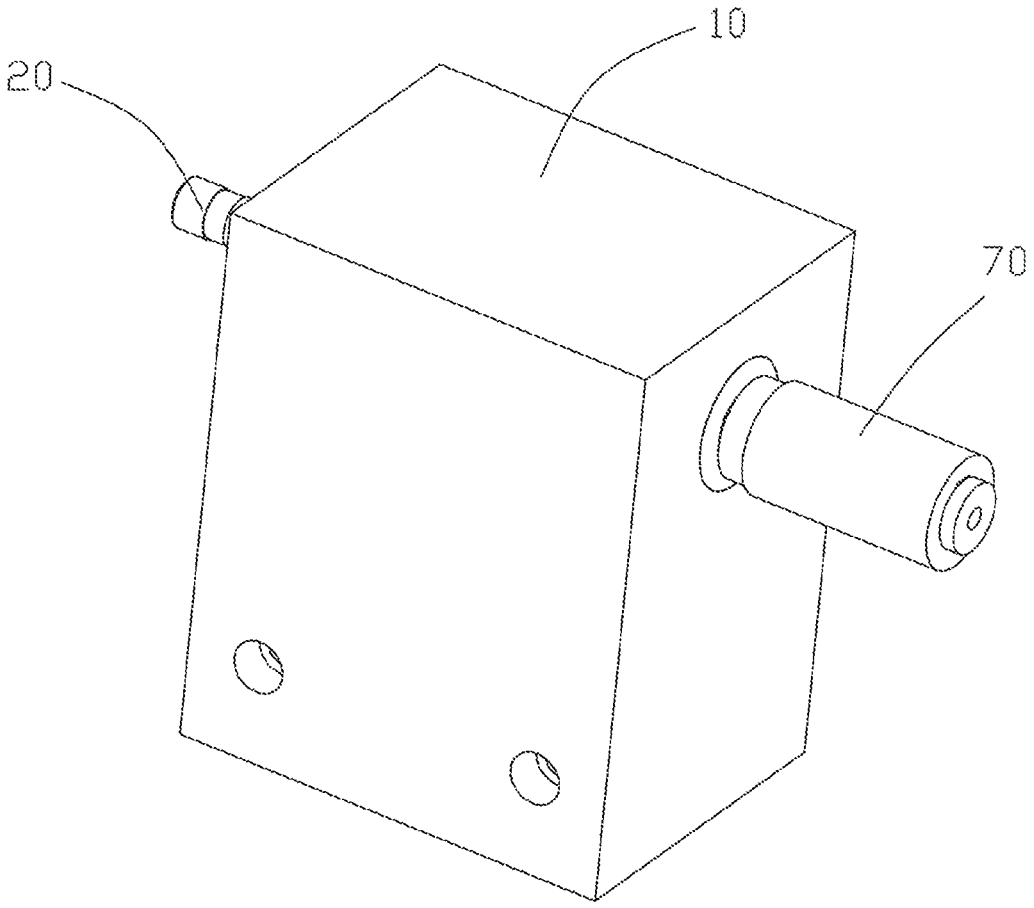
FIG. 2 is another perspective view schematically showing structure of a spindle mechanism of a winding machine according to some examples described herein.
Figure 3:
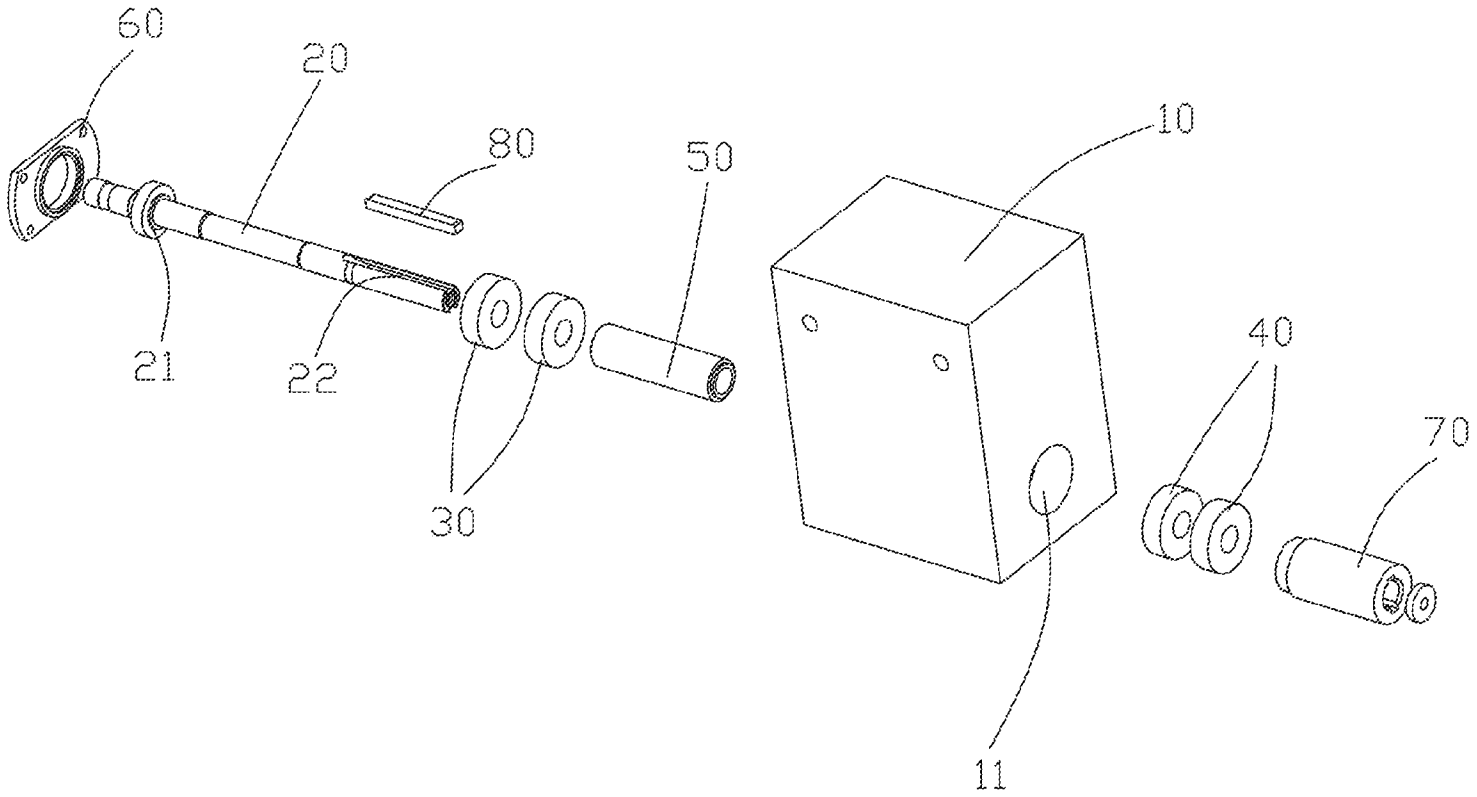
FIG. 3 is an exploded view schematically showing a spindle mechanism of a winding machine according to some examples described herein.
Figure 4:
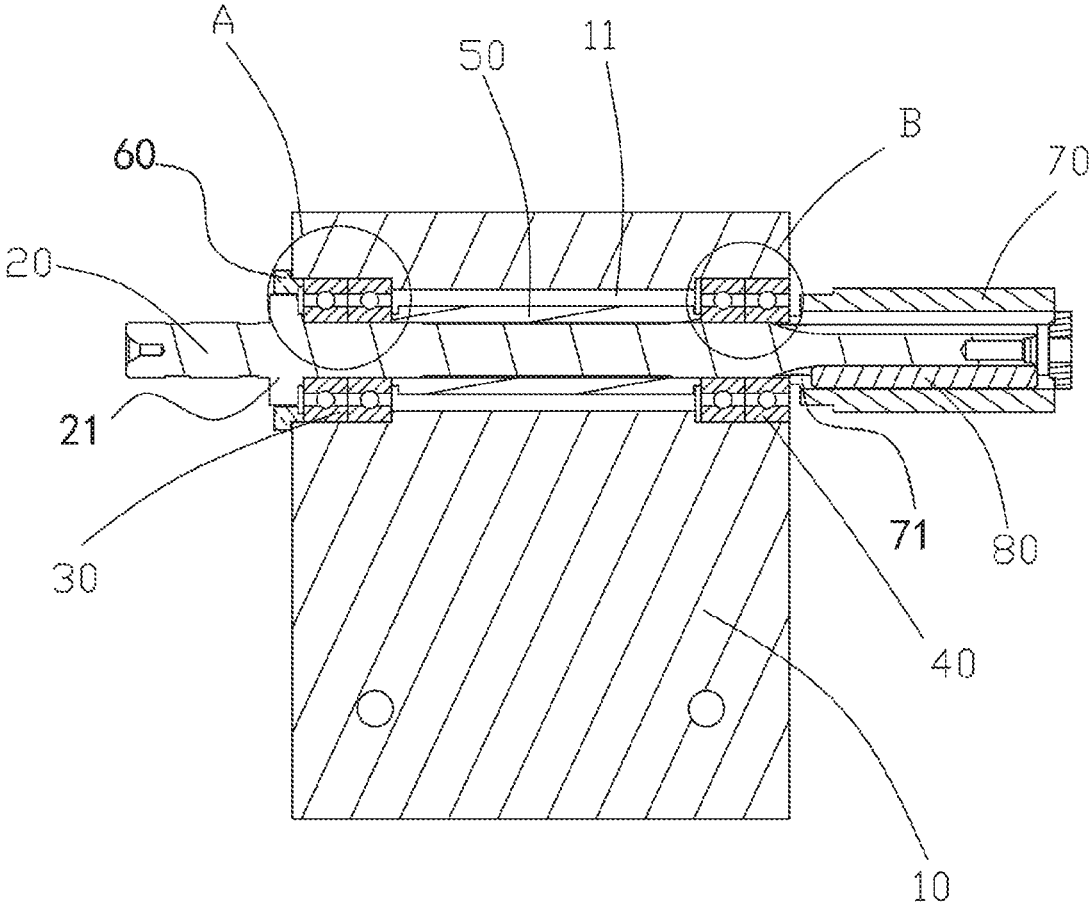
FIG. 4 is a sectional view schematically showing a spindle mechanism of a winding machine according to some examples described herein.

To further illustrate various embodiments of the present invention, there is provided the accompanied drawings. The drawings are part of the present invention, which is mainly used to illustrate embodiments and to explain the principles in the embodiments in conjunction with relevant depiction of the description. With reference to these content, those skilled in the art should understand other possible embodiments and advantages of the present invention. Components in the drawings are not drawn to scale, and similar components are denoted by like reference numerals.

The present invention will now be further described in conjunction with the accompanied drawings and specific embodiments.

The present invention improves the mounting structure of the bearings. The rotation speed and the lifespan of the spindle of winding machine are further increased to easily remove the spindle mechanism of winding machine.

As shown in FIGS. 1 to 7, the present invention provides a spindle mechanism of a winding machine. The spindle mechanism comprises: a spindle box 10, a spindle 20, bearings, a sleeve 50 and a bearing cap 60. The spindle box 10 is provided with a mounting hole 11. The diameter of the middle portion of the mounting hole 11 is smaller than the diameter at both ends thereof to form limit structure of limit steps 111 and 112. The bearings are deep groove ball bearing, and are respectively arranged at both ends of the mounting hole of the spindle box 10 to form front bearings 30 and rear bearings 40. The number of the front bearings 30 is the same as that of the rear hearings 40, and is two. The spindle 20 is arranged to pass through the mounting hole 11 of the spindle box 10 and the inner rings of the front hearings 30 and the rear bearings 40, so as to be rotatably arranged in the spindle box 10 by means of the bearings.

The sleeve 50 are sleeved on the spindle 20 between the front bearings 30 and the rear bearings 40, and both ends of the sleeve 50 respectively abut against the inner rings of front bearing 30 and rear bearing 40. The sleeve 50 is spaced away from the inner wall of the mounting hole 11 of the spindle box 10 to ensure that there is no contact friction between the sleeve 50 and the spindle box 10.

The present disclosure is respectively provided with a first abutting portion 21 outside the front bearings 30 and a second abutting portion 71 outside the rear bearings 40. The first abutting portion 21 and the second abutting portion 71 respectively abut against the inner rings of front bearing 30 and rear bearing 40, and together with the sleeve 50, collectively clamp and fix the front bearings 30 and the rear bearings 40, to prevent the bearings from being offset on the spindle 20. In the present particular embodiment, the first abutting portion 21 that abuts against the inner ring of front hearing 30 is integrally formed with the spindle, and the second abutting portion 71 that abuts the inner ring of rear bearing 40 is an extended structure of a synchronous wheel 70 that is sleeved on the spindle 20. The extended structure of the synchronous wheel 70 is configured as the second abutting portion 71 that abuts against the inner ring of rear bearing 40, such that the synchronous wheel 70 is removably sleeved on the end of the spindle 20. The specific way of embodying this arrangement is as below. The spindle 20 is provided with a groove 22 at the end thereof. The synchronous wheel 70 is provided an opening 72. A slot 73 extends from the opening 72 into the synchronous wheel. A key 80 of synchronous wheel is engaged within the groove 22 of the spindle 20. The opening 72 of the synchronous wheel 70 is sleeved on the spindle 20, while the key 80 of synchronous wheel is engaged within the slot 73 of the synchronous wheel 70, so as to form a fixed engagement, which is common way of engagement.

Figure 5:
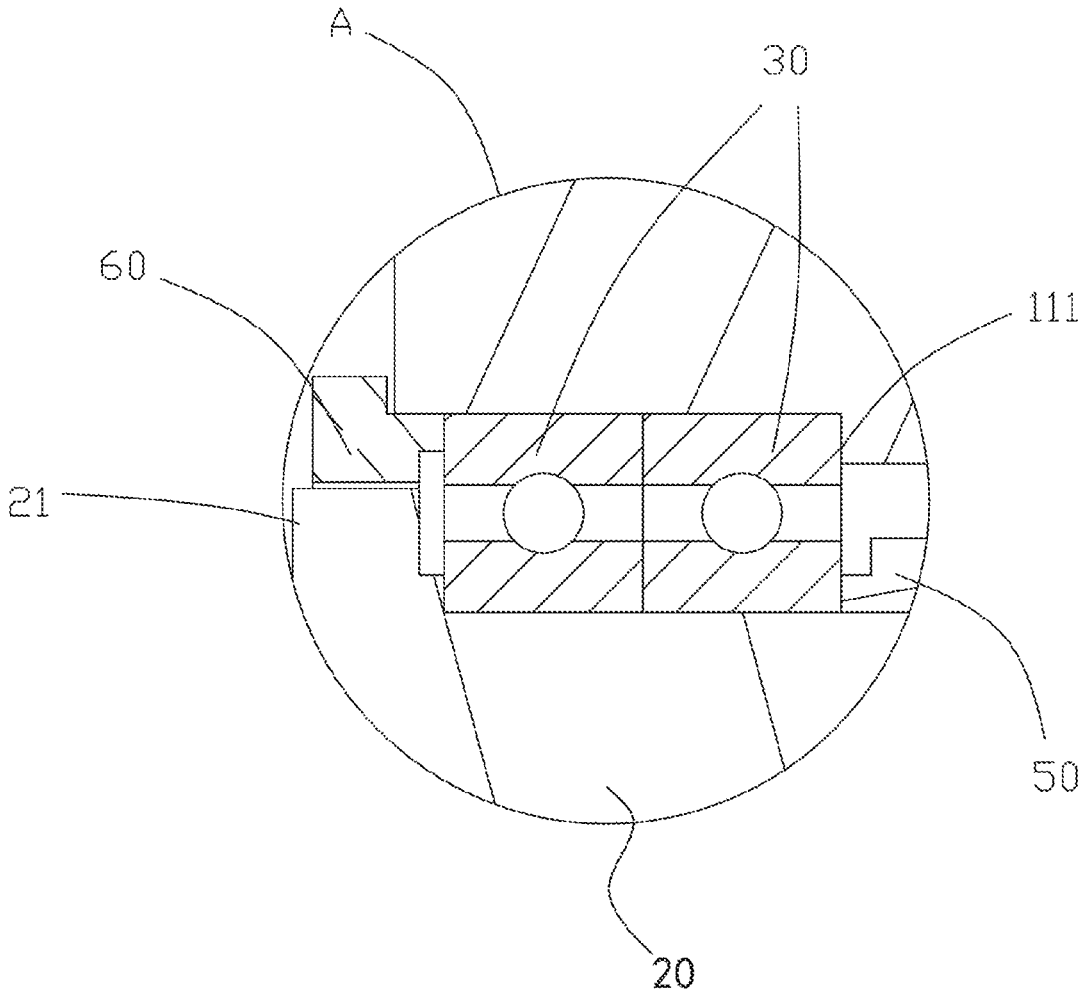
FIG. 5 is an enlarged view schematically showing region A of FIG. 4.
Figure 6:
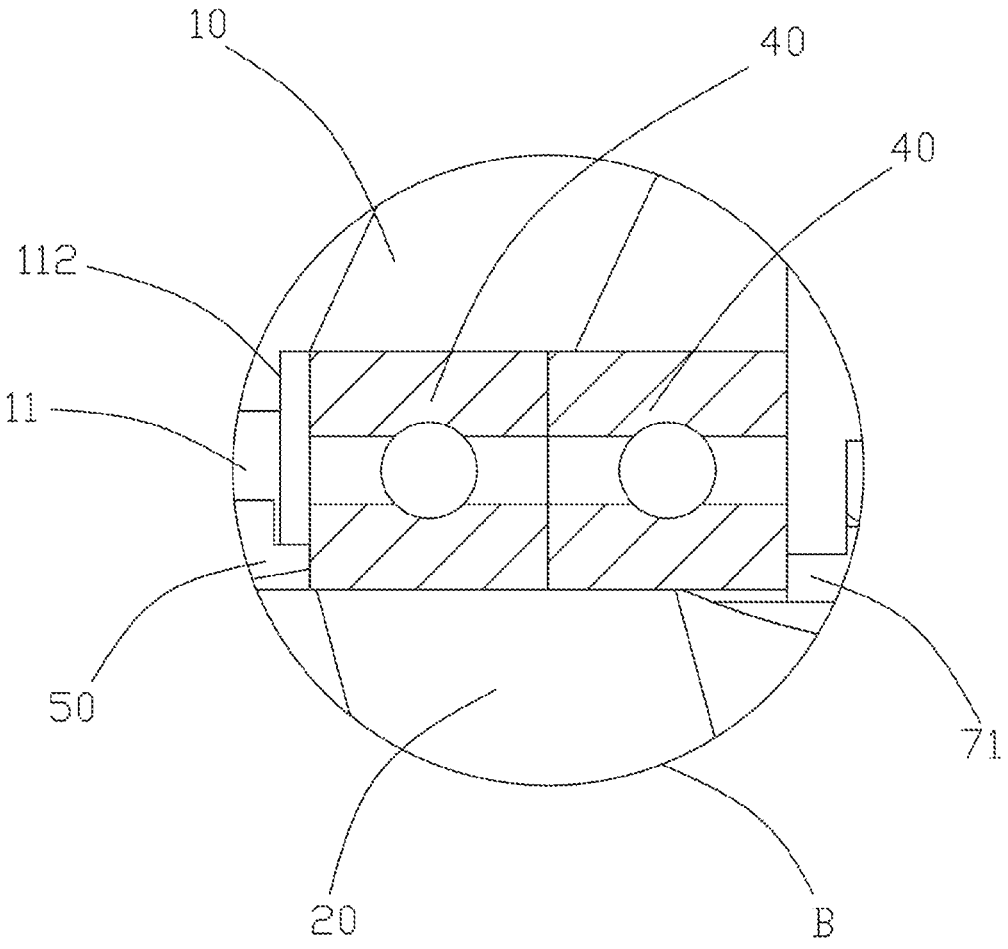
FIG. 6 is an enlarged view schematically showing region B of FIG. 4.
Figure 7:
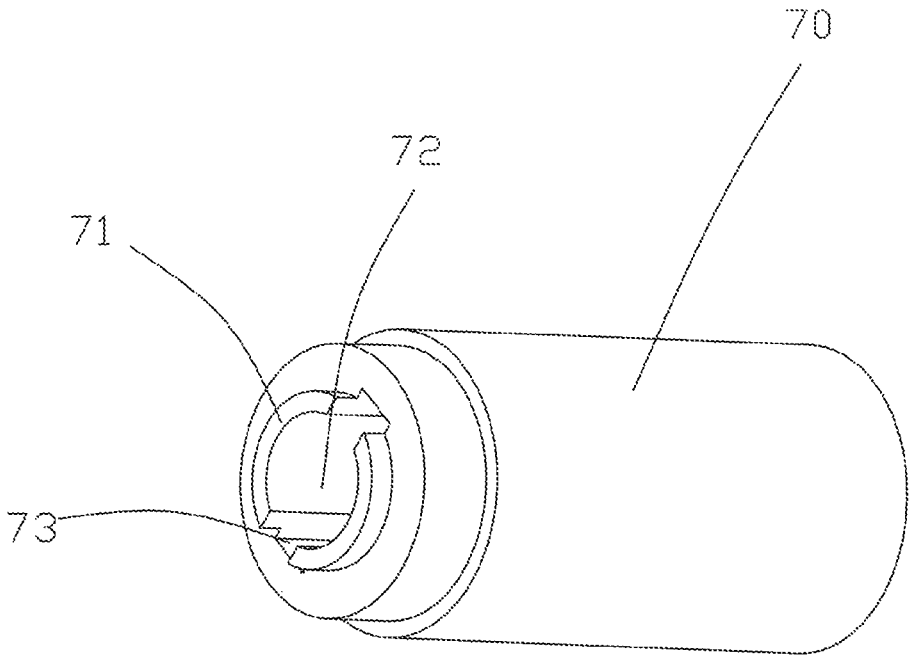
FIG. 7 is a view schematically showing structure of a synchronous wheel of a spindle mechanism of a winding machine according to some examples described herein.

The bearing cap 60 covers the front end of the mounting hole 11 and presses against the outer ring of front bearings 30, such that the outer ring of front bearing 30 is fixed between the bearing cap 60 and the limit step 111, so as to completely fix the outer ring of front bearing 30 on the spindle box 10, thereby ensuring that the spindle 20 cannot move in the axial direction, as shown in FIG. 5. The outer rings of the rear bearings 40 in the axial direction are not restricted thereby forming a free end. As shown in FIG. 6, a gap is provided between the outer rings of the rear bearings 40 and the limit step 112 of the spindle box 10, while the other end is entirely open to ensure that the outer rings of the rear bearings 40 can freely move in the axial direction.

By means of the structure used in the present embodiment, compared with the existing technology in the related technology, among the detection data of the circular runout of the spindle of winding machine, the circular runout of the initial installation is 0.001 mm. After a 24-hour running-in at 1000 rpm (round per minute), the circular runout of the existing spindle structure is 0.003 mm, while the circular runout of the spindle structure of the present solution is 0.002 mm. After a 24-hour running-in at 1500 rpm, the circular runout of the existing spindle structure is 0.005 vmm, while the circular runout of the spindle structure of the present solution is 0.003 mm. After one month of usage, the circular runout of the existing spindle structure is 0.01 min, while the circular runout of the spindle structure of the present solution is 0.006 mm. After a half year of usage, the circular runout of the existing spindle structure is 0.016 mm, while the circular runout of the spindle structure of the present solution is 0.01 mm. After a year of usage, the circular runout of the existing spindle structure is 0.018 mm, while the circular runout of the spindle structure of the present solution is 0.011 mm. It can be concluded that, through the improved structure of the present solution, the circular runout of the spindle structure can be improved to a large extent to ensure increased stability and lifespan of the spindle structure. Wherein the circular runout means the amount of change in the outer diameter measured on the cross section of the spindle when the spindle rotates one turn.

In the present embodiment, each of the bearings is a deep groove ball bearing, and the number of front bearing 30 is the same as that of rear bearing 40, i.e. two. Compared with angular contact bearing of the existing technology, which is applied to the present structure, the deep groove ball bearing reduces the requirement of assembling and makes assembly simpler. The number of the front bearing 30 is the same as that of the rear bearing 40, which makes the force acted on both ends of the spindle more uniform, and provides improved strength of bearing compared with the structure in which there are two bearings at front end and one bearing at rear end, and better withstands radial force acted on the bearings that is caused by the tension of the synchronous belt at the rear end, and protects the bearings from being damaged under high speed operation. Meanwhile, in other embodiments, the number of front bearing 30 and rear bearing 40 is limited to two and can be adjusted to be one or more according to actual size and loading condition, as long as the number of front bearing is the same as that of rear bearing, which will not be described one example by one example.

Figure 8:
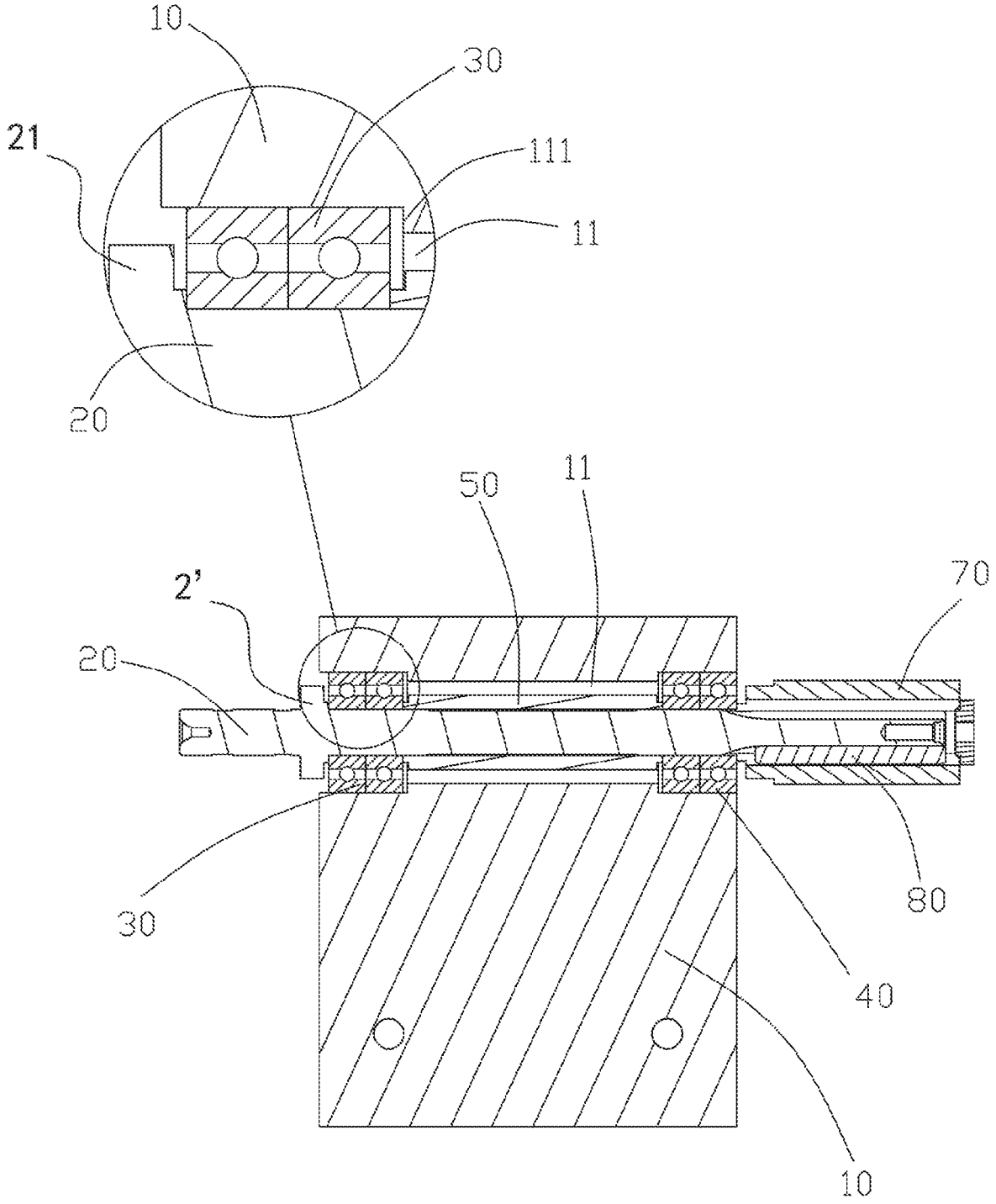
FIG. 8 is a sectional view schematically showing a spindle mechanism of a winding machine according to some examples described herein.

In the present embodiment, the out ring of the front bearing 30 is entirely fixed, to prevent the spindle 20 from being moved in the axial direction. In other embodiments, alternatively, the out ring of the rear bearing 40 may be fixed, and the outer ring of front bearing 30 may be configured in an open way. Furthermore, in the case where the spindle 20 is allowed to be slightly offset, both the outer ring of front bearing 30 and the outer ring of rear bearing 40 can be open to be free end. That is to say, as shown in FIG. 8, when the spindle 20 is offset from the spindle box 10 in the axial direction, the outer ring of the bearing at one end abuts against the limit step, to restrict the spindle from being further offset, so as to restrict the bearings at the other end from being disengaged from the mounting hole 11 of the spindle box 10.

According to the technical solution of the present invention, the number of the front bearings is the same as that of the rear bearings, and the outer ring of bearing at at least one end is not fixed in the axial direction so as to form a free end, which makes the force acted on the spindle at both ends more uniform, so as to provide basis for high speed operation. At the same time, the outer ring of the bearing is in a free state in the axial direction, which can effectively eliminate thermal expansion or contraction of components caused by heat generated due to high speed operation of the bearing and increase the rotation speed of the spindle and reduce the incidence of damage. Through the combination of the above two configurations, the rotation speed of the spindle of the winding machine can be increased from 15000 rpm to 18000 rpm or even higher, which reduces the incidence of damage to the spindle. Originally, damage to the spindle of the winding machine will starts to occur after usage of 24 hours per day for 2 to 3 years, but the lifespan of the spindle can be prolonged to 5 to 6 years after improvement of structure. Furthermore, the outer ring of bearing is in a free state in the axial direction, which can eliminate the machining error and make the assembly, disassembly and replacement simpler.

Although the present invention is concretely demonstrated and introduced in combination with preferred embodiments, those skilled in the art should understand that, without departing from the spirit and scope of the invention as defined in the attached all kinds of modifications can be made to the invention in form and in detail, which all fall within the protection scope of the invention.

The invention claimed is:

1. A spindle mechanism of a winding machine, comprising:

a spindle box, the spindle box is provided with a mounting hole;

bearings, the bearings are respectively arranged at both ends of the mounting hole of the spindle box to form a front bearing and a rear bearing, each of the front and rear bearing comprises an inner ring and an outer ring;

a spindle, the spindle is arranged to pass through the mounting hole of the spindle box and is rotatably positioned on the spindle box by means of the bearings, and a number of bearings in the front bearing is the same as a number of bearings in the rear bearing, and the outer ring of at least one of the front bearing and the rear bearing is not restricted in an axial direction so as to form a free end; and wherein a diameter of a middle portion of the mounting hole is smaller than a diameter at both ends of the mounting hole to form a limit structure of at least one limit step, and when the spindle is offset from the spindle box in the axial direction, the outer ring of the bearing at one end abuts against the at least one limit step, to restrict the spindle from being further offset, so as to restrict the bearing at the other end from being disengaged from the mounting hole of the spindle box.

2. The spindle mechanism of a winding machine according to claim 1, wherein the spindle mechanism further comprises a sleeve sleeved on the spindle between the front bearing and the rear bearing, wherein both ends of the sleeve respectively abut against the inner rings of the front bearing and the rear bearing.

3. The spindle mechanism of a winding machine according to claim 2, wherein the sleeve is spaced away from an inner wall of the mounting hole of the spindle box.

4. The spindle mechanism of a winding machine according to claim wherein the spindle mechanism further comprises a first abutting portion located outside the front bearing and a second abutting portion located outside the rear bearing, wherein the first abutting portion and the second abutting portion respectively abut against the inner rings of the front bearing and the rear bearing, and together with the sleeve, collectively clamp and fix the front bearing and the rear bearing.

5. The spindle mechanism of a winding machine according to claim 4, wherein, the first abutting portion that abuts against the inner ring of the front bearing is integrally formed with the spindle.

6. The spindle mechanism of a winding machine according to claim 4, wherein, the spindle mechanism further comprises a synchronous wheel that is sleeved on the spindle, and the second abutting portion that abuts the inner ring of the rear bearing is an extended structure of the synchronous wheel.

7. The spindle mechanism of a winding machine according to claim 1, wherein the spindle box is provided with the limit structure of multiple limit steps, which restrict the bearings from being disengaged from the mounting hole.

8. The spindle mechanism of a winding machine according to claim 1, wherein the spindle mechanism further comprises a bearing cap, wherein the front bearing abuts against the limit step in a front portion of the spindle, and the bearing cap covers an end of the mounting hole and presses against the outer ring of the front bearing, such that the outer ring of front bearing is entirely fixed on the spindle box, and the outer ring of the rear bearing is a free end in the axial direction.

9. The spindle mechanism of a winding machine according to claim 1, wherein the spindle mechanism further comprises a bearing cap, wherein the rear bearing abuts against the limit step in a rear portion of the spindle, and the bearing cap covers the end of the mounting hole and presses against the outer ring of rear bearing, such that the outer ring of rear bearing is entirely fixed on the spindle box, and the outer ring of front bearing is a free end in the axial direction.

10. The spindle mechanism of a winding machine according to claim 1, wherein both of the front bearing and the rear bearing are deep groove ball bearing.

* * * * *